US011840782B2

(12) United States Patent
Beattie et al.

(10) Patent No.: US 11,840,782 B2
(45) Date of Patent: Dec. 12, 2023

(54) SYNTHETIC RADIATOR FABRIC

(71) Applicant: MMI-IPCO, LLC, Spartanburg, SC (US)

(72) Inventors: Karen Beattie, Epping, NH (US); David J. Anelundi, Derry, NH (US); William Michael Rose, East Hampstead, NH (US); Gadalia Vainer, Melrose, MA (US)

(73) Assignee: MMI-IPCO, LLC, Spartanburg, SC (US)

( * ) Notice: Subject to any disclaimer, the term of this patent is extended or adjusted under 35 U.S.C. 154(b) by 24 days.

(21) Appl. No.: 17/511,669

(22) Filed: Oct. 27, 2021

(65) Prior Publication Data

US 2022/0049391 A1 Feb. 17, 2022

Related U.S. Application Data

(63) Continuation of application No. 16/314,248, filed as application No. PCT/US2017/039780 on Jun. 28, 2017, now abandoned.

(Continued)

(51) Int. Cl.

| | |
|---|---|
| ***D04H 3/11*** | (2012.01) |
| ***D04H 3/011*** | (2012.01) |
| ***D04B 1/24*** | (2006.01) |
| ***A41D 31/102*** | (2019.01) |
| ***A41D 31/12*** | (2019.01) |
| ***D02G 3/44*** | (2006.01) |
| ***D04B 1/16*** | (2006.01) |
| ***A41D 31/00*** | (2019.01) |

(52) U.S. Cl.

CPC ..... *D04H 3/011* (2013.01); *A41D 31/00* (2013.01); *A41D 31/102* (2019.02); *A41D 31/12* (2019.02);

(Continued)

(58) Field of Classification Search

CPC ..... A41D 31/125

See application file for complete search history.

(56) References Cited

U.S. PATENT DOCUMENTS

| | | | |
|---|---|---|---|
| 2002/0112499 | A1 | 8/2002 | Goldfine |
| 2012/0177904 | A1 | 7/2012 | Gehring, Jr. |
| 2014/0201892 | A1 | 7/2014 | Kolmes |

FOREIGN PATENT DOCUMENTS

| | | |
|---|---|---|
| CN | 2839315 | 11/2006 |
| CN | 101404903 A | 4/2009 |

(Continued)

OTHER PUBLICATIONS

International Preliminary Report on Patentability and Written Opinion; PCT/US2017/039780; dated Jan. 10, 2019; 8 pages.

(Continued)

*Primary Examiner* — William P Watkins, III

(74) *Attorney, Agent, or Firm* — Cheryl J. Brickey

(57) ABSTRACT

A synthetic radiator fabric with permanent mechanical wicking defines an inner surface and has a raised knit body defining an opposite outer surface. The fabric includes hydrophilic and hydrophobic fiber-containing yarns. At the inner surface, the hydrophilic fiber-containing yarns collect liquid sweat from a wearer's skin surface and maintain the collected sweat at the inner surface, generally in the vicinity of and/or in contact with the wearer's skin, for encouraging evaporation of sweat and providing evaporative cooling. The raised knit body extends from the inner surface toward, and defines, the opposite outer surface. The hydrophobic fiber-containing yarns are arranged in a radiator-like construction forming egg-crate or honey-comb like cells or pores, defined by the knit body and open to the inner surface. At the outer fabric surface, the hydrophobic fibers receive excess sweat from the wearer's body, thereby to encourage rapid evaporation and drying, for improved breathability.

8 Claims, 5 Drawing Sheets

Related U.S. Application Data

(60) Provisional application No. 62/356,251, filed on Jun. 29, 2016.

(52) U.S. Cl.
CPC ..... *A41D 31/125* (2019.02); *D02G 3/44* (2013.01); *D04B 1/16* (2013.01); *D04B 1/24* (2013.01); *A41D 2500/10* (2013.01); *D10B 2401/021* (2013.01); *D10B 2401/022* (2013.01); *D10B 2501/00* (2013.01)

(56) References Cited

FOREIGN PATENT DOCUMENTS

| | | |
|---|---|---|
| CN | 102031622 | 4/2011 |
| CN | 102373564 | 3/2012 |
| KR | 20140134982 | 11/2014 |

OTHER PUBLICATIONS

International Search Report and Written Opinion; PCT/US2017/039780; dated Oct. 18, 2017; 14 pages.

Martina Kink: Polartec Delta—Polartec launcht für Soirmer 2017 den ersten kUhlenden Stoff, Jun. 2, 2G16 (Jun. 20, 2016), XP055413732, Retrieved from the Internet: URL: http://www.projects-haniburg.de/wordpress/wp-content/uploads/2016/06/PM-Polartec-Delta Launch.pdf [retrieved on Oct. 9, 2017]; with English Translation; 4 pages.

Polartec; Delta™ Sell Sheet; "Change How You Dress for Warm Weather"; Release Date Jun. 29, 2016; 2 pages.

PolartecLLC: "Polartec Delta(TM)", youtube, Jun. 10, 2016, XP054977790, Retrieved from the Internet: URL:https://www.youtube.com/watch?v=shq9A38_s64 [retrieved on Oct. 10, 2017]; 2 pages.

TrailRunning Review: "Polartec Delta"; Feb. 17, 2016; 1 page; https://www.youtbe.com/watch?v-279WdeMrOce; retrieved Nov. 1, 2017.

Inside surface

Outside surface

SYNTHETIC RADIATOR FABRIC

This application claims priority from U.S. Provisional Patent Application No. 62/356,251, filed Jun. 29, 2016, the entire disclosure of which is incorporated herein by reference.

TECHNICAL FIELD

This invention relates to fabrics, and more particularly to improved synthetic radiator fabrics with permanent mechanical wicking.

BACKGROUND

Cotton is considered to be the king of casual warm weather attire. It is highly breathable, and it absorbs body moisture vapor and light sweat from our bodies so we feel less sticky. It is also more cool and comfortable when worn in higher heat conditions, e.g., as compared to synthetic fabrics. However, it is recognized that under relatively heavier exertion, cotton will "wet-out", i.e., excess moisture (sweat) makes the cotton fibers swell, creating a barrier to breathability. A feel-good cotton T-shirt can then become a soggy, uncomfortable mess.

However, that's old news, and among the reasons for 100% polyester and other synthetic garments becoming so popular; i.e., they are quick drying. However, the rapid drying speed of synthetic materials often results in wearing conditions that can make these garments too cool for the comfort of the wearer. For example, distance athletes often complain about the discomfort of flash cooling experienced with sweat-soaked synthetic garments, especially when the temperature drops, and/or when the wind picks up. It is also recognized that when a polyester shirt is dry, its feels relatively warm to the wearer, and no one wants to wear a warm shirt on a hot day or in the gym. However, when it becomes necessary to make a choice, many wearers will put up with the undesirable temperature swings experienced with garments formed of synthetic fabric, thereby to retain the benefits of quick drying, but foregoing the recognized advantages of cotton.

SUMMARY

In general, this disclosure relates to a cooling fabric technology somewhat akin to vehicle radiators, but that uses the body's natural cooling processes, namely, sweat, to create a permanent mechanical wicking fabric that transfers heat and sweat away from the wearer's body and out into the air being blown across an outside surface of the fabric. There are no chemical reactions involved in this cooling process, e.g., such as might be found in apparel using a xylitol (i.e., sugar alcohol) finish. Instead, the fabric of this disclosure is a permanent wicking fabric, inspired in part by the structure of car and other vehicle radiators. The novel fabric transfers heat and sweat away from a wearer's body and out into the air being blown across the outside surface of the fabric, the outside surface being spaced advantageously from the wearer's skin surface by the raised fabric structure.

According to the invention, a synthetic radiator fabric with permanent mechanical wicking defines an inner surface and has a raised knit body construction defining an opposite outer surface. The fabric comprises hydrophilic fiber-containing yarns and hydrophobic fiber-containing yarns. The inner surface comprising the hydrophilic fiber-containing yarns collects liquid sweat from a wearer's skin surface and maintains the collected sweat at the inner surface of the synthetic radiator fabric, generally in the vicinity of and/or in contact with the wearer's skin, for encouraging evaporation of the sweat and providing evaporative cooling to the fabric wearer. The raised knit body construction extends from the inner surface toward, and defines, the opposite outer surface, and comprises the hydrophobic fiber-containing yarns arranged in a radiator-like construction, the radiator-like construction forming egg-crate or honey-comb like cells or pores, defined by the knit body and open to the inner surface. At the outer surface of the synthetic radiator fabric, the hydrophobic fibers receive excess sweat from the wearer's body at the outer surface, thereby to encourage rapid evaporation and drying, for improved breathability of the synthetic radiator fabric.

Preferred embodiments of the invention may include one or more of the following additional features. For example, skin cling at the inner surface of the synthetic radiator fabric is reduced via skin surface contact reduction with the yarns of the radiator-like construction. One or more outer surface regions define one or more through-flow apertures in the knit region of hydrophobic fibers for further enhancement of rapid evaporation and drying. The apertures are generally circular, or generally linear. The hydrophilic fibers comprise lyocell. The hydrophobic yarns and the hydrophilic yarns exhibit a contrasting color visibility creating a visible pattern knit in the raised knit body that differentiates between the hydrophilic fibers at the inner surface of the fabric, in engagement with the wearer's skin, and the raised structure of the fabric body formed by the hydrophobic fibers, including the outer surface of the fabric, spaced from the wearer's skin surface.

According to another aspect of the disclosures, a wearable garment comprises synthetic radiator fabrics with permanent mechanical wicking.

The details of one or more embodiments of the invention are set forth in the accompanying drawings and the description below. Other features, objects, and advantages of the invention will be apparent from the description and drawings, and from the claims.

DESCRIPTION OF DRAWINGS

FIG. 9 is an edge view of one embodiment of a raised knit construction of the synthetic radiator fabric with permanent mechanical wicking of the disclosure, while

FIG. 12 is an edge view of another embodiment of a raised knit construction of the synthetic radiator fabric with permanent mechanical wicking of the disclosure, while

FIG. 17 is an edge view of another embodiment of a raised knit construction of the synthetic radiator fabric with permanent mechanical wicking of the disclosure, while

FIG. 20 is an edge view of another embodiment of a raised knit construction of the synthetic radiator fabric with permanent mechanical wicking of the disclosure, while

Like reference symbols in the various drawings indicate like elements.

DETAILED DESCRIPTION

Figure 1:
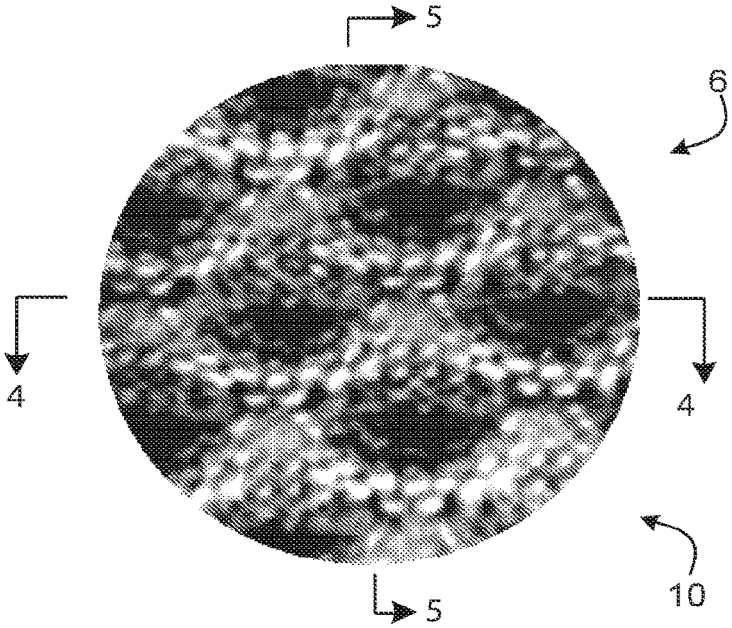
FIG. 1 is a face plan view of an inside surface 6, i.e., a surface facing/disposed for contact with a wearer's skin, of a synthetic radiator fabric 10 with permanent mechanical wicking of this disclosure.
Figure 2:
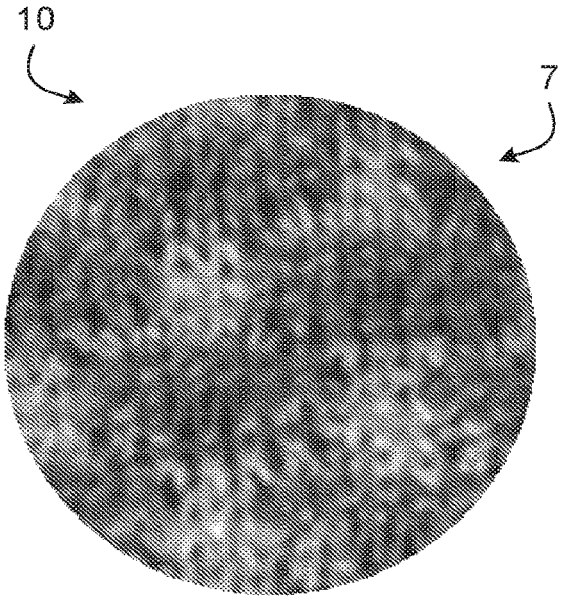
FIG. 2 is a similar, face plan view of an outside surface 7, i.e., a surface spaced from a wearer's skin and exposed to flow of air, of the synthetic radiator fabric with permanent mechanical wicking of FIG. 1.
Figure 3:
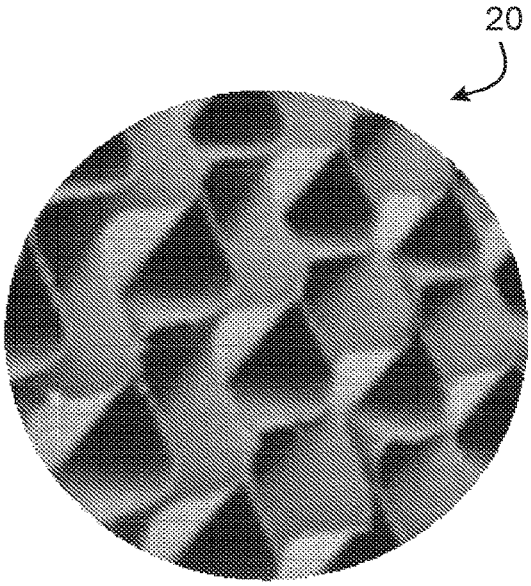
FIG. 3 is a face plan view of an example of a metal radiator grid 20 exhibiting "egg-crate" or "honeycomb-like cell" elements conceptually similar to the "egg-crate" or "honeycomb-like cell" elements of the synthetic fabric with permanent mechanical wicking of the present disclosure.
Figure 4:
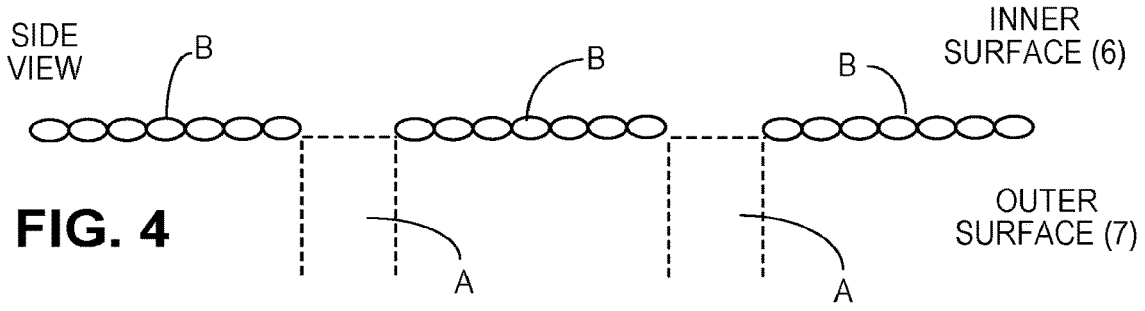
FIGS. 4 and 5 are side face views of a set of multiple "egg-crate" or "honeycomb-like cell" elements of a synthetic radiator fabric with permanent mechanical wicking of this disclosure, taken in resection at the lines 4-4 and 5-5, respectively, of FIG. 1.
Figure 5:
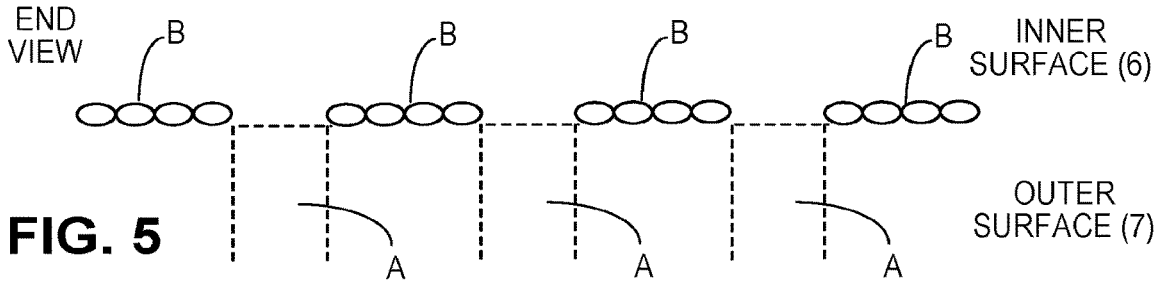
Figure 6:
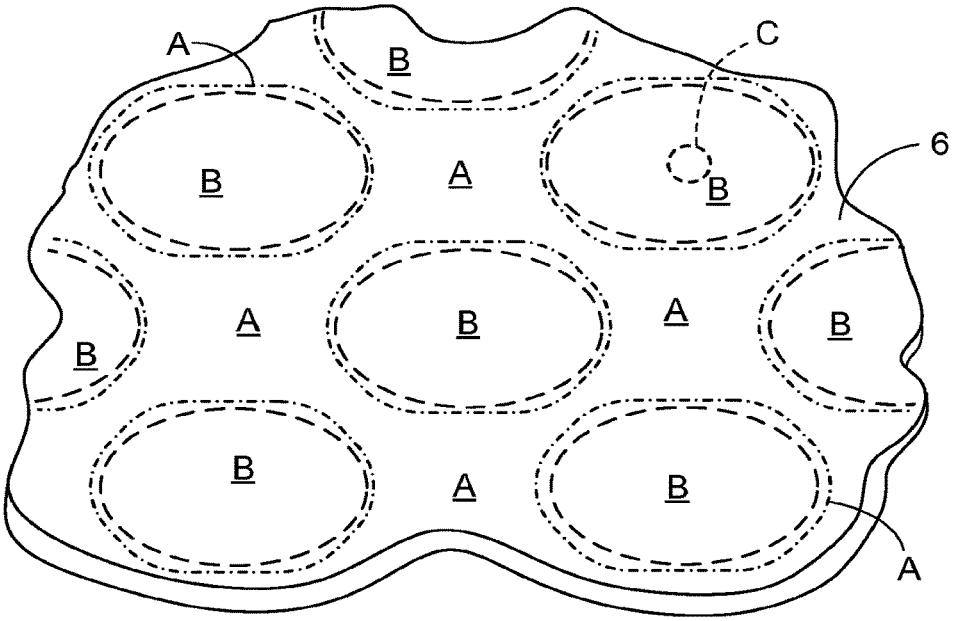
FIG. 6 is a somewhat diagrammatic face plan view of the exposed, inside surface 6 of a synthetic radiator fabric 10 having permanent mechanical wicking of the disclosure, with air-flow apertures (B) dispersed across the fabric surface (A).

The synthetic radiator fabric 10 with permanent mechanical wicking of the disclosure, e.g. as shown in FIGS. 1 and 2, was developed and is available commercially under the trademarks Polartec® DELTA™ fabric. As mentioned above, the synthetic radiator fabric with permanent mechanical wicking of the disclosure was inspired, at least in part, by the vehicle radiator grid or matrix (or matrices). As well known, metal radiators and the like can take different shapes, but with the common characteristic of fanning out across a surface to transfer heat from one region to another region. As will be described, the primary method of achieving heat transfer with the synthetic radiator fabric 10 with permanent mechanical wicking of the present disclosure is evaporative cooling (as in contrast to the radiative heating and cooling known with standard radiator elements). In particular, the radiating elements in the synthetic radiator fabric 10 with permanent mechanical wicking (also referred to commercially as "DELTA™" fabric) are formed of hydrophobic yarns (e.g., polyester) and hydrophilic yarns (e.g., Tencel® Lyocell (the trademark Tencel® is owned by Lenzing AG.)) "Lyocell" is a form of rayon, which consists of cellulose fiber made from dissolving pulp (bleached wood pulp) using jet-wet spinning. The placement of these hydrophilic yarns, located at the inner surface 6 of the fabric 10, serve to maximize the spread of sweat across the fabric, while holding a desired amount directly on the wearer's skin for maximum evaporative cooling. These hydrophilic yarns 6 prolong the natural evaporative cooling response of the wearer's skin, and hydrophobic yarns 7 forming or defining the openings in fabric matrix offer maximum breathability at the outer surface, spaced from the wearer's skin.

The technology of the synthetic radiator fabric 10 with permanent mechanical wicking may be visible to the wearer. For example, the material of the cooling (hydrophilic) fibers may take dye differently, and/or the knit patterns may be suggestive of being "air conditioned". As a result, the color visibility of the cooling (hydrophilic) yarns may create a pattern visible and/or may be knit into a raised knit structure or body 8 that differentiates between hydrophilic fibers at inner surface 6 of the fabric, in engagement with the wearer's skin, and the raised structure 8 of the fabric body 10 formed by the hydrophobic material, including at the outer surface of the fabric, spaced from the wearer's skin surface.

Additional cooling comfort features of the synthetic radiator fabric 10 with permanent mechanical wicking of the disclosure also include reduced skin cling, e.g., via reduction of inner fabric surface-to-skin contact. The synthetic radiator fabric 10 with permanent mechanical wicking also has a desirably cool touch to the wearer's skin, due, e.g., to the rapid evaporative cooling achieved as a result of the hydrophilic fibers/yarns of the inner surface 6. The synthetic radiator fabric 10 with permanent mechanical wicking can also be treated to provide odor control, and also to provide enhanced UPF ("Ultra Protection Factor") protection on most styles.

The synthetic radiator fabric 10 with permanent mechanical wicking is known commercially in many channels as "DELTA™", or as "Polartec®" "DELTA™" synthetic radiator fabric with mechanical wicking, because "delta" means change. For example, it will change how a person dresses for warm weather activity. In fact, the "DELTA™" fabric is referred to by many as the "Goldilocks" of fabrics because it can be just right in many situations, i.e., neither too hot, nor too cool. The "DELTA™" fabric can successfully navigate a middle ground of natural fibers and synthetic fibers, with comfort cues taken from cotton for immediate and long term cooling ability, and taken from synthetics for their fast dry time, reduced wet cling and chaffing. The real proof to "DELTA™" fabric is in the wearing, but its performance is fully backed by solid textile science.

The synthetic radiator fabric 10 with permanent mechanical wicking ("DELTA™") was developed by research-and-development engineers asked to construct a fabric radiator for cooling. Traditionally, a radiator is a structure that facilitates transfer of heat from one region or space to a region or space located somewhere else. Sweating is recognized as the primary mechanism for our bodies to dump excess heat when it's hot. The "DELTA™" fabric 10 has been devised and developed to maximize the effectiveness of the natural sweat response of a wearer's body. In actual use, the "DELTA™" fabric radiator carries a wearer's sweat and holds it right next to the skin, where it does the most good, with the wearer benefiting from evaporative cooling, i.e., by removal of the excess body heat, as the fabric dries.

The "DELTA™" synthetic radiator fabric 10 with permanent mechanical wicking does not use metal fins, e.g. as in an actual radiator. Rather, it uses yarns. The fabric construction features hydrophilic yarns (e.g., seen as white in FIG. 1), which are knit into a radiator matrix that will prolong the skin's natural cooling response. This hydrophilic yarn will absorb and distribute water/sweat across the inner surface 6 (closer to the wearer's skin) of the fabric. It works in a manner somewhat similar to coolant in a car's radiator. That is, it carries and distributes the sweat across the inner surface 6, so that your skin can benefit from evaporative cooling. Hydrophobic zones 7, 8 (which appear in darker color, e.g. might be shown in orange in color drawings (FIGS. 1 and 2), created by synthetic yarn and a special knit construction selected for promotion of maximum breathability and a quick dry time. The special knit structure can reduce wet skin cling, and the yarns are chosen to have a naturally cool touch that a wearer will want to put on when the conditions are hot. The "DELTA" synthetic radiator fabric 10 with permanent mechanical wicking also has odor control, which serves to perfect the experience, and a UPF rating in the mid weight range, selected to help keep a wearer safe and comfortable when outside in the sun, especially for extended periods.

Figure 10:
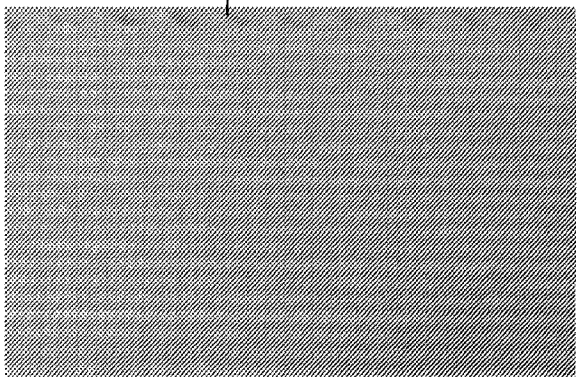
FIG. 10 is face plan view of an inner (i.e., facing/engaging a wearer's skin) surface of, and FIG. 11 is a similar face plan view of an opposite, outer (i.e., spaced from the wearer's skin) surface, of the raised knit construction of the synthetic radiator fabric with permanent mechanical wicking.
Figure 16:
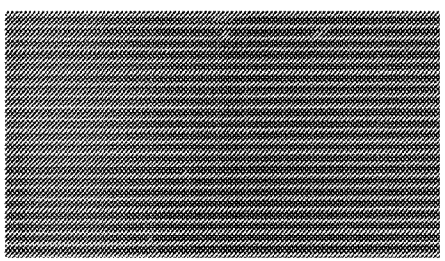
FIGS. 15 and 16 are respective plan views of representative radiator grids 20, e.g., with mesh-form (e.g., metal), with grids having generally straight radiating fins.
Figure 15:
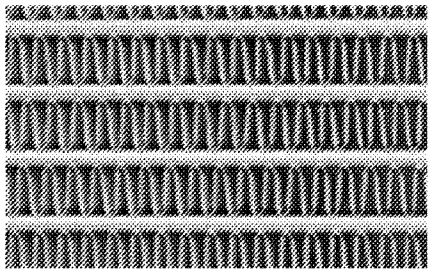

Representative examples of typical metal radiator grids are shown in FIG. 10 (e.g., grid 12 having generally circular apertures for air movement) and in FIG. 15 and FIG. 16 (e.g. grids 50 and 60, having generally linear apertures for air movement).

Figure 11:
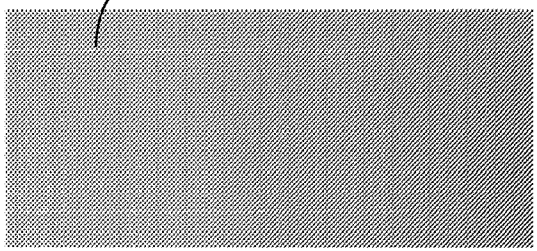
Figure 14:
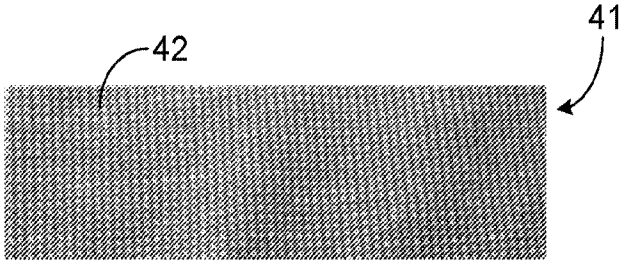
Figure 9:
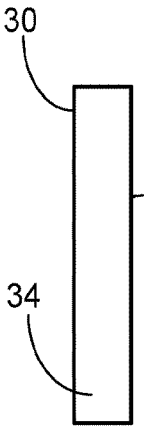
Figure 12:
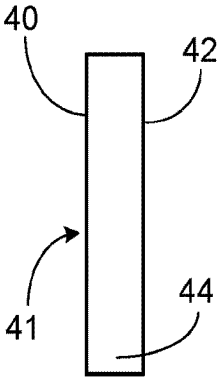
Figure 13:
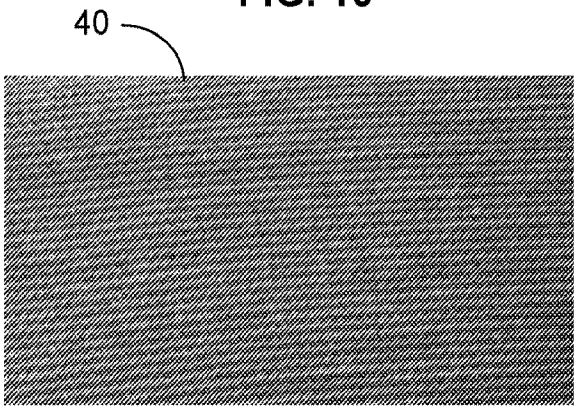
FIG. 13 is face plan view of an inner (i.e., facing/engaging a wearer's skin) surface of, and FIG. 14 is a similar face plan view of an opposite, outer (i.e., spaced from the wearer's skin) surface, of this embodiment of the raised knit construction of the synthetic radiator fabric with permanent mechanical wicking.
Figure 19:
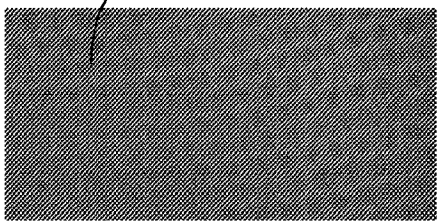
Figure 17:
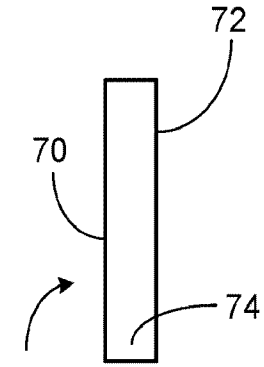
Figure 18:
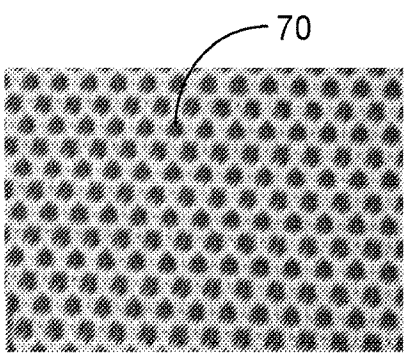
FIG. 18 is face plan view of an inner (i.e., facing/engaging a wearer's skin) surface of, and FIG. 19 is a similar face plan view of an opposite, outer (i.e., spaced from the wearer's skin) surface, of this embodiment of the raised knit construction of the synthetic radiator fabric with permanent mechanical wicking.
Figure 22:
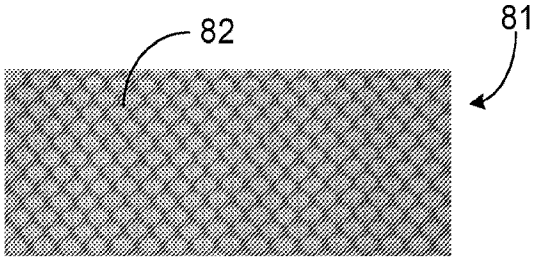
Figure 20:
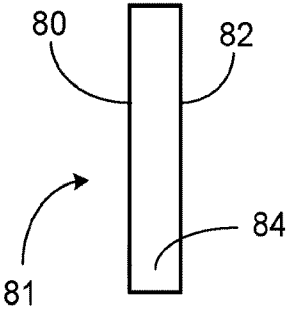
Figure 21:
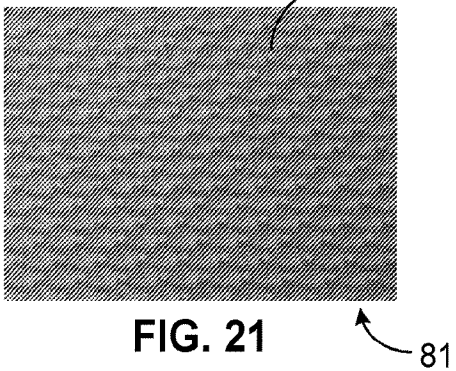
FIG. 21 is face plan view of an inner (i.e., facing/engaging a wearer's skin) surface of, and FIG. 22 is a similar face plan view of an opposite, outer (i.e., spaced from the wearer's skin) surface, of this embodiment of the raised knit construction of the synthetic radiator fabric with permanent mechanical wicking.

Examples of synthetic radiator fabrics 10 of the disclosure, with permanent mechanical wicking are shown, e.g., in FIGS. 9 through 22. In particular:

FIG. 9 shows an end edge 34 of the raised knit body construction 31, while FIGS. 10 and 11 also show face plan views of each of the inner surface 30 and the outer surface 32) also indicated in FIG. 9);

FIG. 12 shows an end edge 44 of the raised knit body construction 41, while FIGS. 13 and 14 also show face plan views of each of the inner surface 40 and the outer surface 42 (also indicated in FIG. 12;

FIG. 17 shows an end edge 74 of the raised knit body construction 71, while FIGS. 18 and 19 also show face plan views of each of the inner surface 70 and the outer surface 72 (also indicated in FIG. 17); and FIG. 20 shows an end edge 84 of the raised knit body construction 81, while FIGS. 21 and 21 also show face plan views of each of the inner surface 80 and the outer surface 82 (also indicated in FIG. 20).

Performance of the "DELTA™" synthetic radiator fabric 10 with permanent mechanical wicking has been assessed in Polartec's controlled test chamber, including for settings at a hot, moderately humid environment. During these tests, a metal plate with water releasing pores was used to imitate hot sweating skin. The "DELTA™" synthetic radiator fabric 10 with permanent mechanical wicking was placed on top of the plate and the evaporative cooling that occurred (in watts of heat energy extracted from the "skin" plate) was measured. This Polartec test was derived from the skin-model testing in ISO 11092 (Textiles—Physiological effects—Measurement of thermal and water-vapor resistance under steady-state conditions (sweating guarded-hot plate test (2014)).

Figure 7:
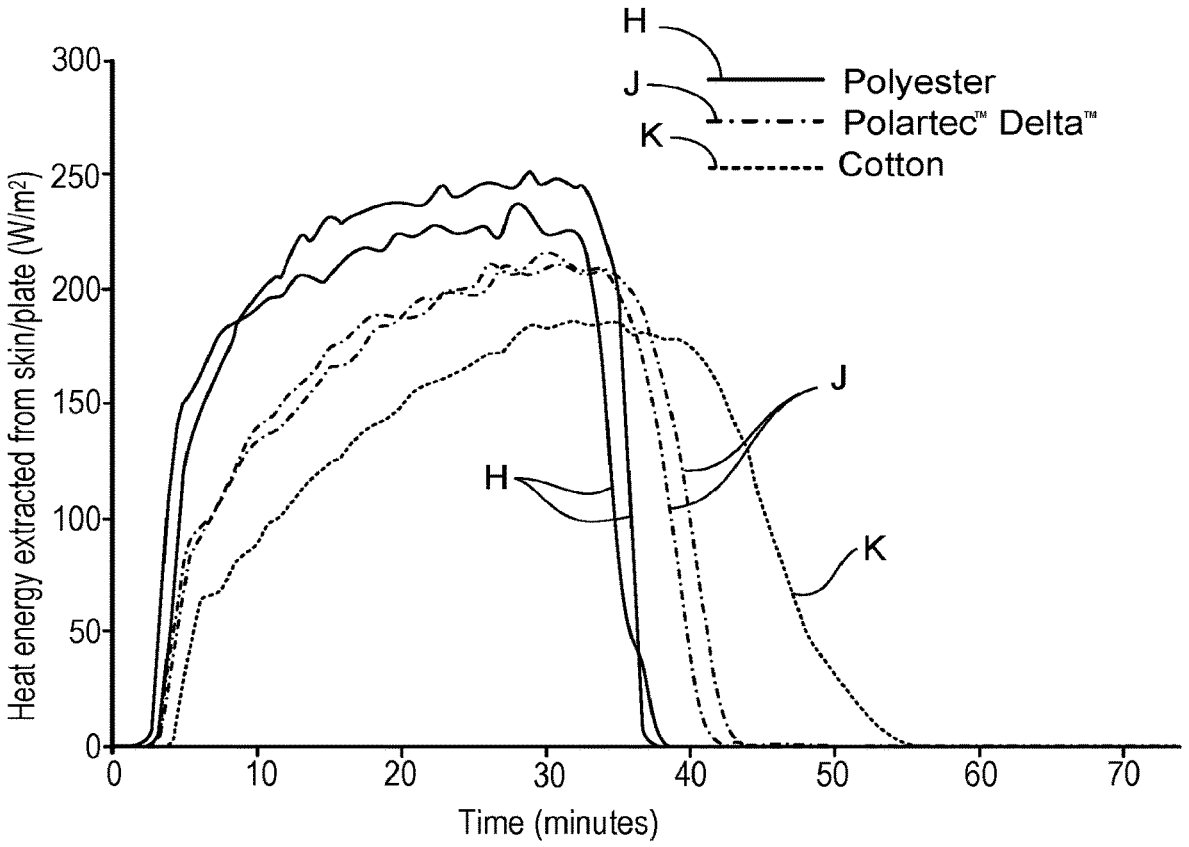
FIG. 7 is a representative chart of cooling response for a synthetic radiator fabric with permanent mechanical wicking of this disclosure, plotting heat energy extracted from the skin or a test plate ($W/m^2$) versus Time (minutes), for a polyester fabric (indicated by solid line(s), H), for a synthetic radiator fabric with permanent mechanical wicking of this disclosure (indicated by dash-dot-dash line(s), J), and for cotton fabric (indicated by dotted line, K).
Figure 8:
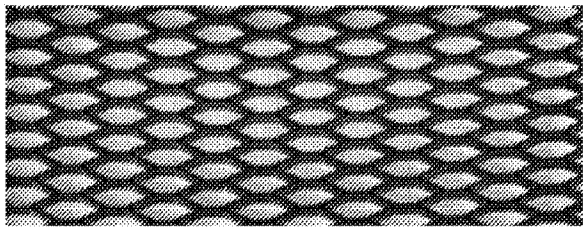
FIG. 8 is a plan view of a representative radiator grid 12, e.g., with mesh-form (e.g., metal) grid.

As described above, the "DELTA™" synthetic radiator fabrics 10 with permanent mechanical wicking fabrics from Polartec sit in the sweet spot (or so-called "Goldilocks" zone) between cotton and polyester. The "DELTA™" fabrics exhibit a comfortable cooling pattern similar to that of cotton, but also act more like polyester for dry times, and for maintaining breathability when wet. Referring now to FIG. 7, the diagram shows the comparable dry time and breathability performances of the Polartec® "DELTA™" fabric, 100% Polyester fabric, and Cotton 100% fabric.

Breathability & Dry Time

| Fabric | Dry Time (minutes*) | Breathability when dry (RET**) | Breathability when wet (RET***) |
|---|---|---|---|
| Polartec ® DELTA ™ | 15 | 2.7-4.0 | 24 |
| 100% Polyester | 8 | 2.5-3.0 | 17 |
| 100% Cotton | 28 | 4.0-5.0 | 31 |

*Average Dry Time from skin model testing
**RET (water vapor resistance) per ISO11092 (2014)
*RET (water vapor resistance) from skin modeling during sweat phase Technical Highlights and Performance Characteristics In summary, the synthetic radiator fabric 10** with permanent mechanical wicking ("DELTA™") offers the critical advantages of combinations of:

- Cool touch;
- Superior wicking action (with hydrophilic yarns prolonging the skin's natural evaporative cooling response);
- High breathability, with hydrophobic zones in the knit matrix promoting maximum breathability;
- Reduced skin cling via surface contact reduction, for reduced chaffing and the reduced perception of being sweaty;
- Regulated drying; and
- Odor control.

In whole, The POLARTEC® DELTA™ fabric 10 further provide:

- Advanced cooling next-to-skin fabric technology;
- Optimal Base: and
- Hydrophilic yarns prolong skin's natural evaporative cooling response.

POLARTEC® "DELTA™" Fabrics:

Polartec DELTA™ synthetic radiator fabrics 10 with permanent mechanical wicking sit in the sweet spot, or "Goldilocks" zone, between cotton and polyester. These DELTA™ fabrics exhibit a comfortable cooling pattern similar to cotton, but act more like polyester for dry times and maintaining breathability when wet.

Polartec, LLC, a premium provider of innovative textile solutions, has launched its first cooling platform, Polartec® Delta™, a permanent mechanical wicking fabric that has permitted athletes and adventurers to evolve in their dress for performance in warmer climates. Inspired by the design of car and other vehicle radiators, the DELTA™ fabric is constructed of an optimal base layer that provides wicking capabilities, reduces skin cling, regulates drying and is highly breathable without any chemical treatments.

Traditionally, athletes turned to cotton, polyester or other synthetic garments in warmer climates, but then found them lacking because they either soaked through or weren't breathable. The Polartec DELTA™ fabric sits in the sweet spot between cotton and polyester, shifting what it means to perform in warm weather. Polartec created its first cooling fabric to maximize the effectiveness of the body's natural sweat response. The DELTA™ fabric 10 carries sweat and holds it next to skin where it most closely replicates the human body's natural cooling processes while still allowing the fabric to dry quickly. Whether the athlete is a long distance runner, paddle boarding under intense heat or pushing themselves through a "WOD" ("Workout of the Day"), the DELTA™ fabric 10 provides comfort, reduces wet cling and chaffing and helps control odor.

With DELTA™ fabric, Polartec is now a four-season brand. DELTA™ fabric makes working out, running or doing anything in a warm climate in a wet cotton t-shirt a thing of the past. The fabric helps athletes stay in that "Just Right" zone where they can maximize their performance without overheating.

Polartec fabrics are normally associated with apparel that keeps you warm and dry. In order to now become a four-season brand; however, in Polartec has now created its first cooling fabric in Polartec DELTA™ fabric.

There are no chemical reactions involved in the cooling process like might currently be found in some apparel that uses a xylitol finish. Instead, the DELTA™ fabric 10 is a permanent mechanical wicking fabric that was inspired by the design of car and other vehicle radiators, in that it transfers heat and sweat away from the wearer's body and out to the air being blown across the outside of the fabric. This maximizes the effectiveness of the natural sweat response combined with the evaporative cooling process.

Polartec's DELTA™ fabric sits in the sweet spot between cotton and polyester, with a unique honeycomb structure that carries the sweat away from the wearer's skin, but holds it close enough for the wearer to get the benefits of the cooling as it evaporates. The result is a shirt or other garment that does not stick to the wearer as he or she sweats, dries quickly, cuts down on chaffing, and feels comfortable and soothing to wear.

Polartec's DELTA™ fabric was created so that cooling fabric technologies can better utilize the body's natural cooling process—sweat. In contrast, next-to-skin fabrics that target wicking and drying only keep moisture vapor moving, and do not work to actually solve overheating. DELTA™ fabric works harder and smarter by elevating yarns for increased airflow, optimizing moisture dispersal, and reducing friction against the skin.

Polartec's DELTA™ fabric 10 is engineered with elevated structures knit across the fabric surface to increase airflow, reduce friction, and dissipate heat. This specialized knit construction is enhanced with a hydrophobic and hydrophilic yarn blends for advanced moisture management. The DELTA™ innovative fabric composition regulates drying times and allows breathability when wet. By working in "sync" with the body's natural cooling response, the DELTA™ fabric outperforms other base fabrics in overly warm or hot conditions.

There are no chemical reactions involved in the cooling process, e.g. like might be expected or might be currently found, in some apparel that uses xylitol finish. Instead, the DELTA™ fabric is a permanent mechanical wicking fabric that was inspired by the design of car and other vehicle radiators, i.e., it transfers heat and sweat away from your body and out to the air being blown (or otherwise moving) across the outside of the fabric.

Polartec's DELTA™ fabric 10 sits in the sweet spot between cotton and polyester, with a special honeycomb structure that carries the swear away from the wearer's skin, but holds is close enough that the wearer gets the benefits of the cooling as it (the sweat) evaporates. The result is a shirt (or other garment) that does not stick to the wearer's skin as he/she as they sweat, dies quickly, cuts down on chaffing, and feels comfortable, and even soothing, to wear.

A number of embodiments of the invention have been described. Nevertheless, it will be understood that various modifications may be made without departing from the spirit and scope of the invention. Accordingly, other embodiments are within the scope of the following claims.

What is claimed is:

1. A synthetic radiator fabric with permanent mechanical wicking, the fabric defining an inner surface and the fabric having a raised knit body construction defining an opposite outer surface, and wherein the fabric consists of two sets of yarns: a first set of hydrophilic fiber-containing yarns and a second set of hydrophobic fiber-containing yarns, wherein the first set of hydrophilic fiber-containing yarns consist of rayon and the second set of hydrophobic fiber-containing yarns consist of polyester, the inner surface comprising the first set of hydrophilic fiber-containing yarns collecting liquid sweat from a wearer's skin surface and maintaining the collected sweat at the inner surface of the synthetic radiator fabric, generally in the vicinity of and/or in contact with the wearer's skin, for encouraging evaporation of the sweat and providing evaporative cooling to the fabric wearer, the raised knit body construction extending from the inner surface toward, and defining, the opposite outer surface, and comprising the second set of hydrophobic fiber-containing yarns arranged in a matrix of radiating elements defining a plurality of pores formed by the hydrophobic fibers, defined by the knit body and open to the inner surface, wherein the raised structure of the fabric body is formed by the first set of hydrophobic fibers, and at the outer surface of the synthetic radiator fabric, the hydrophobic fibers receiving excess sweat from the wearer's body at the outer surface, thereby to encourage rapid evaporation and drying, for improved breathability of the synthetic radiator fabric.

2. The synthetic radiator fabric with permanent mechanical wicking of claim 1, wherein, skin cling at the inner surface of the synthetic radiator fabric is reduced via skin surface contact reduction with the raised knit body construction.

3. The synthetic radiator fabric of claim 1, wherein one or more outer surface regions define one or more through-flow apertures in the knit region of the first set of hydrophobic fibers for further enhancement of rapid evaporation and drying.

4. The synthetic radiator fabric of claim 3, wherein the apertures are generally circular.

5. The synthetic radiator fabric of claim 3, wherein the apertures are generally linear.

6. The synthetic radiator fabric of claim 1, wherein the hydrophilic fibers comprise lyocell.

7. The synthetic radiator fabric of claim 1, wherein the hydrophobic yarns and the hydrophilic yarns exhibit a contrasting color visibility creating a visible pattern knit in the raised knit body that differentiates between the hydrophilic fibers at the inner surface of the fabric, in engagement with the wearer's skin, and the raised structure of the fabric body formed by the hydrophobic fibers, including the outer surface of the fabric, spaced from the wearer's skin surface.

8. A wearable garment comprising the synthetic radiator fabrics with permanent mechanical wicking of claim 1.

* * * * *